US009001021B2

(12) United States Patent
Jang

(10) Patent No.: US 9,001,021 B2
(45) Date of Patent: Apr. 7, 2015

(54) DISPLAY DEVICE AND DRIVING METHOD THEREOF

(75) Inventor: Dae-Gwang Jang, Incheon (KR)

(73) Assignee: Samsung Display Co., Ltd. (KR)

( * ) Notice: Subject to any disclaimer, the term of this patent is extended or adjusted under 35 U.S.C. 154(b) by 242 days.

(21) Appl. No.: 13/421,061

(22) Filed: Mar. 15, 2012

(65) Prior Publication Data

US 2013/0113764 A1 May 9, 2013

(30) Foreign Application Priority Data

Nov. 7, 2011 (KR) ..... 10-2011-0115237

(51) Int. Cl.
*G09G 3/36* (2006.01)
*G09G 3/34* (2006.01)

(52) U.S. Cl.
CPC ..... *G09G 3/342* (2013.01); *G09G 2320/0646* (2013.01)

(58) Field of Classification Search
None
See application file for complete search history.

(56) References Cited

U.S. PATENT DOCUMENTS

| | | | | |
|---|---|---|---|---|
| 2009/0184917 | A1 | 7/2009 | Park et al. | |
| 2011/0141090 | A1 * | 6/2011 | Hong et al. | 345/211 |
| 2011/0141154 | A1 | 6/2011 | Ahn et al. | |
| 2011/0148941 | A1 | 6/2011 | Kim et al. | |

FOREIGN PATENT DOCUMENTS

| | | |
|---|---|---|
| JP | 2009075550 | 4/2009 |
| JP | 2009294499 | 12/2009 |
| JP | 2010008681 | 1/2010 |
| KR | 1020090114294 | 11/2009 |
| KR | 1020100106703 | 10/2010 |
| KR | 1020100109748 | 10/2010 |
| KR | 1020110067352 | 6/2011 |
| KR | 1020110067620 | 6/2011 |

* cited by examiner

*Primary Examiner* — Joseph Haley
*Assistant Examiner* — Ifedayo Iluyomade
(74) *Attorney, Agent, or Firm* — Cantor Colburn LLP

(57) ABSTRACT

A display device includes: a display panel which displays an image; a light source unit which provides light to the display panel; and a light source controller which transmits a control signal to the light source unit, wherein the light source unit includes a light source including a plurality of light emission blocks, the light source controller includes a first reference determining unit which determines first references based on an input image signal, a reference difference calculator which calculates at least one reference difference for neighboring light emission blocks by using first references, a parameter generator which generates at least one parameter by using the at least one reference difference, and a second reference determining unit which determines a second reference for a corresponding light emission block by using the first references and the at least one parameter.

16 Claims, 19 Drawing Sheets

| | | | | |
|---|---|---|---|---|
| R11 | R12 | ··· | R1(m-1) | R1m |
| R21 | R22 | ··· | R2(m-1) | R2m |
| ⋮ | ⋮ | ⋮ | ⋮ | ⋮ |
| R(n-1)1 | R(n-1)2 | ··· | R(n-1)(m-1) | R(n-1)m |
| Rn1 | Rn2 | ··· | Rn(m-1) | Rnm |

FIG.9

(a)

Light emission block position: L → R

| | img 1 | img 2 | img 3 | img 4 | img 5 | img 6 | img 7 | img 8 | img 9 | img 10 |
|---|---|---|---|---|---|---|---|---|---|---|
| First reference (G1) | 454 | 0 | 444 | 758 | 671 | 0 | 0 | 719 | 734 | 784 |
| | 522 | 0 | 706 | 745 | 731 | 0 | 0 | 0 | 0 | 784 |
| | 729 | 0 | 750 | 819 | 731 | 819 | 0 | 0 | 0 | 784 |
| | 710 | 0 | 761 | 847 | 734 | 847 | 719 | 0 | 0 | 784 |
| | 742 | 1023 | 753 | 731 | 726 | 0 | 0 | 0 | 0 | 784 |
| | 751 | 1023 | 746 | 859 | 724 | 0 | 0 | 0 | 0 | 784 |
| | 761 | 1023 | 631 | 0 | 723 | 793 | 0 | 0 | 0 | 784 |
| | 774 | 1023 | 394 | 891 | 721 | 1020 | 0 | 0 | 0 | 784 |

(b)

| | img 1 | img 2 | img 3 | img 4 | img 5 | img 6 | img 7 | img 8 | img 9 | img 10 |
|---|---|---|---|---|---|---|---|---|---|---|
| Para_t | 864 | 0 | 984 | 749 | 1019 | 903 | 968 | 883 | 879 | 1023 |

(c)

Light emission block position: L → R

| | img 1 | img 2 | img 3 | img 4 | img 5 | img 6 | img 7 | img 8 | img 9 | img 10 |
|---|---|---|---|---|---|---|---|---|---|---|
| Second reference (G2) | 454 | 0 | 694 | 758 | 728 | 638 | 609 | 719 | 734 | 784 |
| | 616 | 0 | 721 | 845 | 731 | 723 | 644 | 621 | 631 | 784 |
| | 729 | 0 | 750 | 819 | 732 | 819 | 681 | 536 | 542 | 784 |
| | 710 | 0 | 761 | 847 | 734 | 847 | 719 | 463 | 466 | 784 |
| | 742 | 1023 | 753 | 731 | 732 | 748 | 681 | 399 | 400 | 784 |
| | 751 | 1023 | 746 | 859 | 729 | 795 | 644 | 345 | 344 | 784 |
| | 761 | 1023 | 718 | 653 | 726 | 901 | 609 | 297 | 296 | 784 |
| | 774 | 1023 | 690 | 891 | 723 | 1020 | 577 | 257 | 254 | 784 |

DISPLAY DEVICE AND DRIVING METHOD THEREOF

This application claims priority to Korean Patent Application No. 10-2011-0115237, filed on Nov. 7, 2011, and all the benefits accruing therefrom under 35 U.S.C. §119, the content of which in its entirety is herein incorporated by reference.

BACKGROUND OF THE INVENTION (1) Field of the Invention

The disclosure relates to a display device and a driving method thereof, and more particularly, to a display device including a light source and a driving method thereof.

(2) Description of the Related Art

Flat panel displays largely include a self-light-emitting display device that emits its own light to display an image, such as a light emitting diode ("LED") display device, a field emissive display ("FED") device, a vacuum fluorescent display ("VFD") device, and a plasma display panel ("PDP"), and a passive (non-emissive) display device that does not emit light itself and requires a light source such as a liquid crystal display ("LCD") and an electrophoretic display.

The passive display device includes a display panel displaying an image and a backlight unit (otherwise referred to as a light source unit) providing light to the display panel. The light source unit includes a light source for generating light. Examples of the light source include a cold cathode fluorescent lamp ("CCFL"), a flat fluorescent lamp ("FFL"), and a light emitting diode ("LED").

To prevent a decrease of a contrast ratio of the display device and to reduce power consumption, the light source is divided into a plurality of light emission blocks and a light quantity of each light emission block is individually controlled. Such approach is referred to as a local dimming driving method.

BRIEF SUMMARY OF THE INVENTION

An embodiment of the invention provides a driving method of a display device including a local dimming driving method capable of decreasing power consumption and increasing a contrast ratio in the display device including a light source.

A display device according to an exemplary embodiment of the invention includes: a display panel which displays an image; a light source unit which provides light to the display panel; and a light source controller which transmits a control signal to the light source unit, wherein the light source unit includes a light source including a plurality of light emission blocks, and wherein the light source controller includes a first reference determining unit which determines first references for the plurality of the light emission blocks based on an input image signal, a reference difference calculator which calculates at least one reference difference for neighboring light emission blocks by using first references for corresponding light emission blocks, a parameter generator which generates at least one parameter by using the at least one reference difference, and a second reference determining unit which determines a second reference for a corresponding light emission block by using the first references for the plurality of light emission blocks and the at least one parameter.

The parameter generator may normalize the at least one reference difference for the neighboring light emission blocks to generate the at least one parameter corresponding to the neighboring light emission blocks.

The at least one reference difference may be determined as an absolute value of a difference between the first references of the neighboring light emission blocks or an n square (n is a natural number larger than 1) of the difference between the first references of the neighboring light emission blocks.

The second reference determining unit may determine a first value by multiplying a parameter, which corresponds to a first light emission block and a second light emission block neighboring the first light emission block by the first reference of the first light emission block, determine a second value as the first reference of the second light emission block, and compare the first value and the second value to determine the second reference of the second light emission block.

The parameter generator may include at least one of, a weight value look-up table which stores at least one weight value respectively corresponding to the neighboring light emission blocks, and a multiplier which multiplies the at least one reference difference by a corresponding weight value to obtain at least one weighted reference.

The parameter generator may normalize the at least one weighted reference calculated for the neighboring light emission blocks to generate the at least one parameter corresponding to the neighboring light emission blocks.

The parameter generator may further include an adding unit which adds the at least one weighted reference.

The parameter generator may generate one single parameter by using an output of the adding unit.

The plurality of light emission blocks may be arranged in an n×m matrix.

The parameter generator may include at least one of, a weight value look-up table which stores at least one weight value respectively corresponding to the neighboring light emission blocks, and a multiplier which multiplies the at least one reference difference by a corresponding weight value to obtain at least one weighted reference, and two light emission blocks neighboring in a row direction or a column direction in a 2×2 matrix may have an identical weight value.

A driving method of a display device includes: determining first references for a plurality of light emission blocks based on an input image signal; calculating at least one reference difference for neighboring light emission blocks by using first references for corresponding neighboring light emission blocks; generating at least one parameter by using the at least one reference difference; determining a second reference for a corresponding light emission block by using the first references for the plurality of the light emission blocks and the at least one parameter; and providing a driving signal to the plurality of the light emission blocks based on the second reference, wherein the display device includes a light source including the plurality of the light emission blocks and a display panel which is provided with light by the light source.

The generating the at least one parameter may include normalizing the at least one reference difference for the neighboring light emission blocks to generate the at least one parameter corresponding to the neighboring light emission blocks.

The generating the at least one parameter may include multiplying the at least one reference difference for the neighboring light emission blocks by at least one weight value corresponding to the neighboring light emission blocks to calculate at least one weighted reference; and normalizing the at least one weighted reference to generate at least one parameter corresponding to the neighboring light emission block.

The generating the at least one parameter may further include adding the at least one weighted reference, and generating one single parameter by using an addition result.

The at least one reference difference may be determined as an absolute value of a difference between the first references of the neighboring light emission blocks or an n square (n is a natural number larger than 1) of the difference between the first references of the neighboring light emission blocks.

The determining the second reference may include determining a first value by multiplying the at least one parameter by the first reference of a first light emission block, determining a second value as the first reference of a second light emission block neighboring the first light emission block, and comparing the first value and the second value to determine the second reference of the second light emission block.

According to an exemplary embodiment of the invention, in a display device including a light source, a local dimming driving method may be embodied by using at least one parameter determined according to an image, such that power consumption may be substantially reduced and/or effectively minimized and the contrast ratio may be increased.

BRIEF DESCRIPTION OF THE DRAWINGS

The above and other aspects, advantages and features of the invention will become more apparent by describing in further detail exemplary embodiments thereof with reference to the accompanying drawings, in which:

FIG. 9 shows tables illustrating examples of a first reference, a parameter, and a second reference of a light emission block corresponding to several exemplary embodiments of images according to the invention;

DETAILED DESCRIPTION OF THE INVENTION

Figure 1:
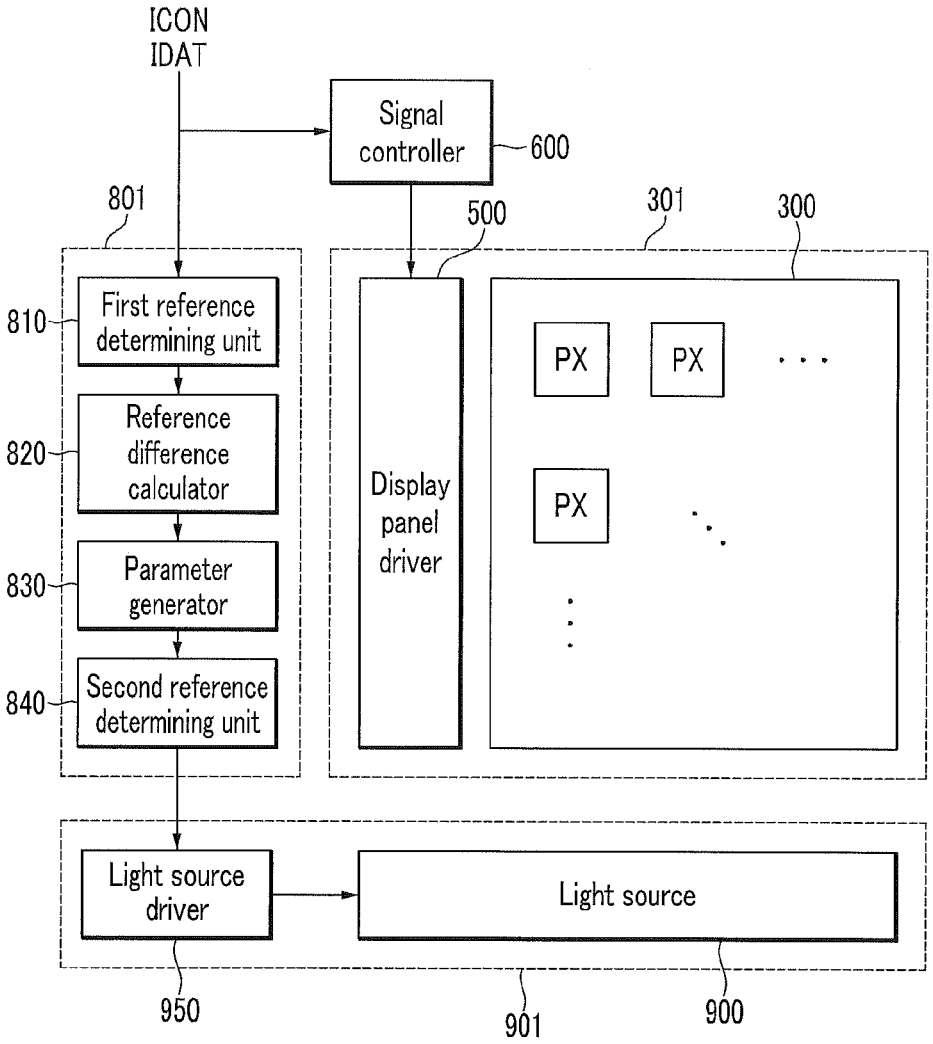
FIG. 1 is a block diagram illustrating an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected.

Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in further detail with reference to the accompanying drawings.

Firstly, a display device according to an exemplary embodiment of the invention will be described with reference to FIG. 1.

FIG. 1 is a block diagram illustrating an exemplary embodiment of a display device according to the invention.

Referring to FIG. 1, a display device according to an exemplary embodiment of the invention includes a display panel unit 301, a signal controller 600, a light source unit 901, and a light source controller 801.

The display panel unit 301 includes a display panel 300 and a display panel driver 500.

The display panel 300 includes a plurality of signal lines and a plurality of pixels PX connected thereto and arranged in an approximate matrix. In a case of a liquid crystal display, the display panel 300 may include two substrates facing each other and a liquid crystal layer interposed therebetween. The plurality of the signal lines includes a plurality of gate lines transmitting a gate signal (or a scanning signal) and a plurality of data lines transmitting a data voltage. Each pixel PX may include a switching element connected to a corresponding gate line and a corresponding data line, and a pixel electrode connected to the switching element.

The display panel driver 500 may include a gate driver connected to the plurality of the gate lines and a data driver connected to the plurality of the data lines. The display panel driver 500 generates a driving signal such as the gate signal, and transmits the data voltage to each pixel PX according to the control of the signal controller 600 through the signal lines of the display panel 300.

The signal controller 600 receives, from an outside, an input image signal IDAT and an input control signal ICON controlling display of the input image signal IDAT to control the display panel driver 500 based on the input image signal IDAT and the input control signal ICON. The input image signal IDAT includes luminance information of each pixel PX, wherein luminance is represented by a certain number of gray levels, for example, $2^n$ (n is a natural number). The input control signal ICON may include a synchronization signal such as a vertical synchronization signal Vsync or a horizontal synchronizing signal Hsync.

The light source unit 901 includes a light source 900 and a light source driver 950.

The light source 900 provides light to the display panel 300, and may be of an edge type or a direct type. The light source 900 includes a plurality of light emission blocks, and each light emission block may include at least one light-emitting device such as a light emitting diode ("LED").

The light source driver 950 generates a driving signal controlling an on/off time and brightness of the light source 900 according to a control signal from the light source controller 801 and provides the driving signal to the light source 900.

The light source controller 801 controls the light source driver 950 and includes a first reference determining unit 810, a reference difference calculator 820, a parameter generator 830, and a second reference determining unit 840.

The first reference determining unit 810 receives the input image signal IDAT and the input control signal ICON from the outside and determines a first luminance reference (hereinafter, referred to as a first reference) of each light emission block of the light source 900 based on the input image signal IDAT corresponding to an image display area of each light emission block. The first reference may have various values such as an average gray value of the input image signal IDAT corresponding to the image display area of each light emission block, a middle gray value between the average gray value and a maximum gray value, or values that are proportional to the middle gray value, the average gray value or the maximum gray value.

The reference difference calculator 820 receives the first reference of the light emission block to calculate at least one reference difference (or referred to as a first reference difference) between the corresponding light emission block and a neighboring light emission block. The reference difference calculated by the reference difference calculator 820 may be, for example, an absolute value of a difference between the first references of the neighboring light emission blocks or an n square (n is a natural number larger than 1) of the difference between the first references of the neighboring light emission blocks. Also, the first reference difference may have a value determined according to various equations using the value of the difference between the first references of the neighboring light emission blocks as a variable.

The parameter generator 830 uses the reference difference calculated by the reference difference calculator 820 to generate at least one parameter. The at least one parameter may correspond to each light emission block, at least two light emission blocks, or the entire light emission blocks.

The second reference determining unit 840 uses the first reference for each light emission block and at least one parameter generated in the parameter generator 830 to determine at least one second reference for each light emission block. The second reference may be understood as the compensated first reference. The second reference for each light emission block is provided to the light source driver 950 as the control signal to be used in generating the driving signal of the light source 900.

Next, the light source unit 901 and the light source controller 801 will be described with reference to FIGS. 2 to 6. A repetitive description will be omitted.

Figure 2:
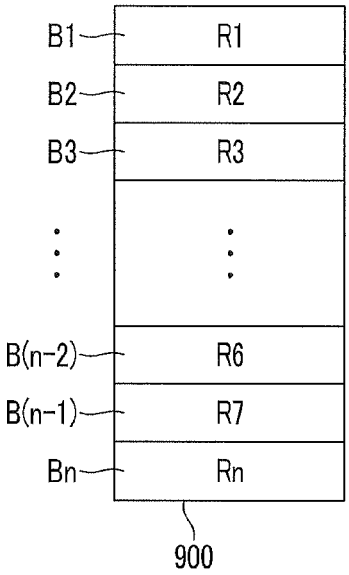
FIG. 2 is a view illustrating an exemplary embodiment of a plurality of blocks of a light source of a display device and a first reference determined by a first reference determining unit according to the invention.
Figure 3:
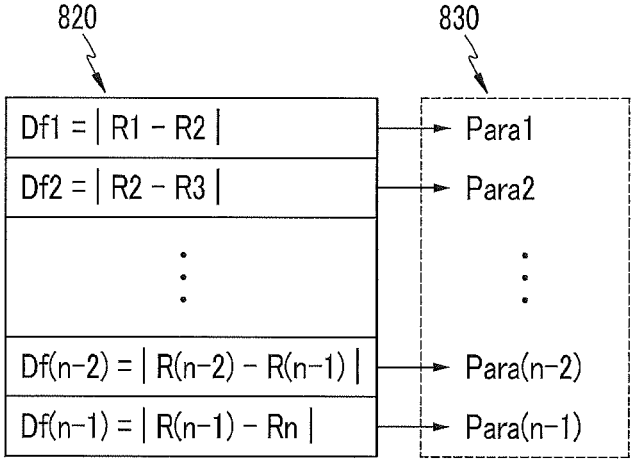
FIG. 3 is a block diagram illustrating an exemplary embodiment of a reference difference calculator and a parameter generator according to the invention.
Figure 4:
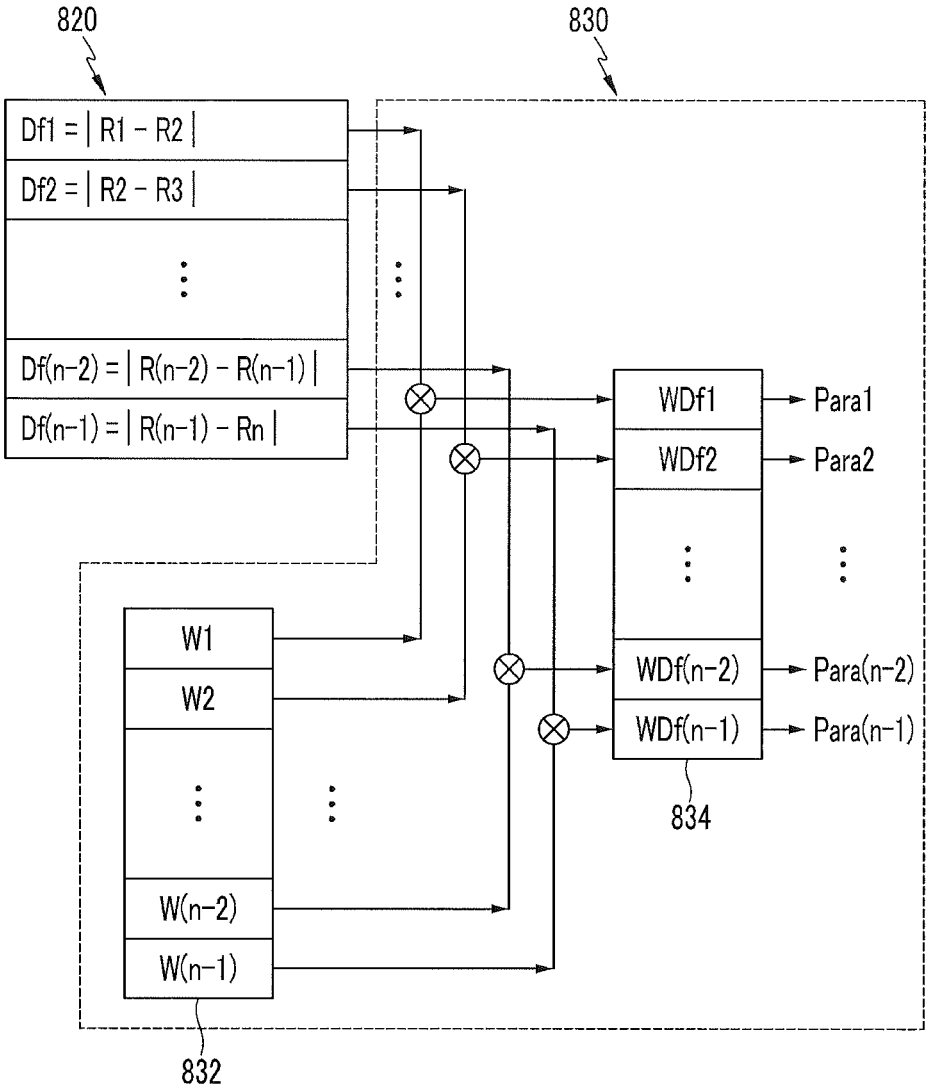
FIG. 4 is a block diagram illustrating another exemplary embodiment of a reference difference calculator and a parameter generator according to the invention.
Figure 5:
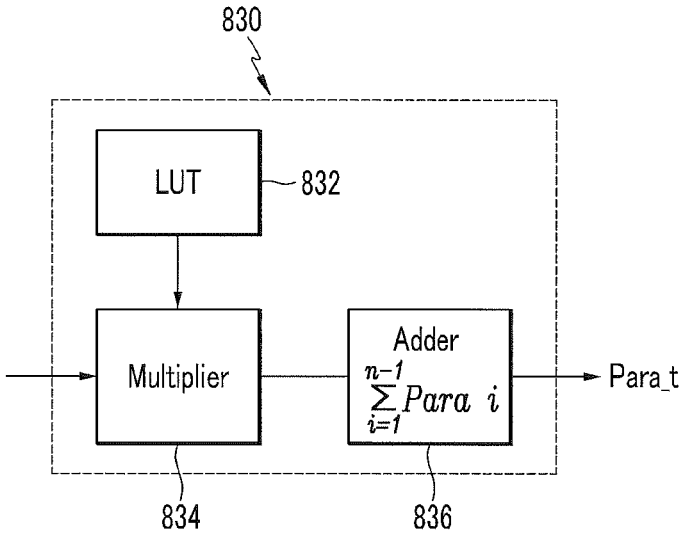
FIG. 5 is a block diagram illustrating still another exemplary embodiment of a parameter generator according to the invention.
Figures 6, 7:
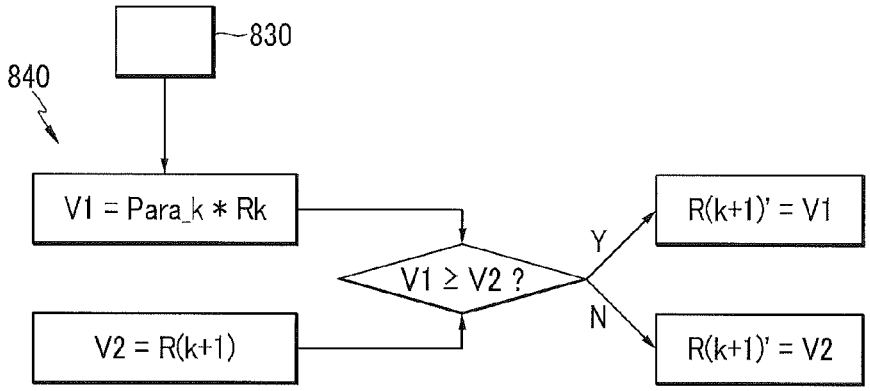
FIG. 6 is a flowchart showing an exemplary embodiment of an operation algorithm of a second reference determining unit according to the invention.
FIG. 7 is a view illustrating another exemplary embodiment of a plurality of blocks of a light source of a display device and a first reference determined by a first reference determining unit according to the invention.

FIG. 2 is a view illustrating an exemplary embodiment of a plurality of blocks of a light source of a display device and a first reference determined by a first reference determining unit according to the invention, FIG. 3 is a block diagram illustrating an exemplary embodiment of a reference difference calculator and a parameter generator according to the invention, FIG. 4 is a block diagram illustrating another exemplary embodiment of a reference difference calculator and a parameter generator according to the invention, FIG. 5 is a block diagram illustrating still another exemplary embodiment of a parameter generator according to the invention, and FIG. 6 is a flowchart showing an exemplary embodiment of an operation algorithm of a second reference determining unit according to the invention.

Firstly, referring to FIG. 2, the light source 900 according to an exemplary embodiment of the invention may be divided into a plurality of light emission blocks B1, . . . , Bn (n is a natural number) arranged in one line along a first direction. In an exemplary embodiment, when a plurality of pixels PX positioned at the display panel 300 are arranged in a matrix form, the first direction in which the plurality of the light emission blocks B1, . . . , Bn are arranged may be a row direction or a column direction. As described above, the first reference determining unit 810 determines first references R1, . . . , Rn corresponding to the light emission blocks B1, . . . , Bn based on the input image signal IDAT.

Next, referring to FIG. 3, the reference difference calculator 820 calculates at least one reference difference Df1, . . . , Df(n−1) corresponding to neighboring light emission blocks B1, . . . , Bn based on the first references R1, . . . , Rn. FIG. 3 shows an example in which the reference differences Df1, . . . , Df(n−1) are absolute values of the difference between the first references R1, . . . , Rn of the neighboring light emission blocks. However, it should be noted that, in an alternative embodiment, the reference differences Df1, . . . , Df(n−1) may be determined as values that are proportional to the difference between the first references R1, . . . , Rn, such as, for example, an n square (n is the natural number larger than 1) of the difference between the first references R1, . . . , Rn, or values that are proportional thereto.

According to an exemplary embodiment of the invention, as shown in FIG. 3, the parameter generator 830 may generate a plurality of parameters Para1, . . . , Para(n−1) through data processing such as normalization of the reference differences Df1, . . . , Df(n−1) corresponding to the neighboring light emission blocks B1, . . . , Bn generated in the reference difference calculator 820. Here, the generated parameters Para1, . . . , Para(n−1) may be represented as percentages.

Referring to FIG. 4, another example of the parameter generator 830 may further include a weight value look-up table 832 and a multiplier 834.

The weight value look-up table 832 stores at least one weight value W1, . . . , W(n−1) respectively corresponding to the neighboring light emission blocks B1, . . . , Bn. In other words, the weight values W1, . . . , W(n−1) may respectively correspond to the reference differences Df1, . . . , Df(n−1). Each of the reference differences Df1, . . . , Df(n−1) depends on the differences of the first references R1, . . . , Rn of the neighboring light emission blocks B1, . . . , Bn. Accordingly, the weight values W1, . . . , W(n−1) correspond to a position of the neighboring light emission blocks B1, . . . , Bn.

In an exemplary embodiment, the weight values W1, . . . , W(n−1) corresponding to a center region of the display panel 300 may have smaller values than the weight values W1, . . . , W(n−1) corresponding to an edge region of the display panel 300. Accordingly, in an image having a luminance that is quickly changed in the center region of the display area, a contrast ratio the display area may be controlled to increase in the center region.

The weight value look-up table 832 may be externally controlled according to a user desired condition, a condition of the display device, or a kind of the input image signal IDAT. Also, at least one weight value W1, . . . , W(n−1) of the weight value look-up table 832 may be determined by considering light diffusion by each light emission block B1, . . . , Bn onto a display area of the other light emission blocks B1, . . . , Bn.

The multiplier 834 multiplies the respective reference differences Df1, . . . , Df(n−1) by respective corresponding weight values W1, . . . , W(n−1) to obtain (n−1) number of the weighted references WDf1, . . . , WDf(n−1). The parameter generator 830 may generate a plurality of parameters Para1, . . . , Para(n−1) by, for example, respectively normalizing the weighted references WDf1, . . . , WDf(n−1).

Referring to FIG. 5, still another example of the parameter generator 830 may further include an adding unit 836 as well as the weight value look-up table ("LUT") 832 and the multiplier 834 as described above. The adding unit 836 may add at least one weighted reference WDf1, . . . , WDf(n−1) or at least one parameter Para1, . . . , Para(n−1) generated in the multiplier 834 to generate a single parameter Para_t. Here, the single parameter Para_t may be a value that is normalized as a percentage, and the single parameter Para_t may be applied to all light emission blocks B1, . . . , Bn.

Referring to FIG. 6, the second reference determining unit 840 according to an exemplary embodiment of the invention determines second references R1', . . . , Rn' by using the first references R1, . . . , Rn for the light emission blocks B1, . . . , Bn and the parameter generated in the parameter generator 830.

In an exemplary embodiment, a method of determining the second reference R(k−1)' of a (k−1)-th light emission block B(k−1) or the second reference R(k+1)' of a (k+1)-th light emission block B(k+1) by using the first reference Rk of the k-th light emission block Bk (k=1, . . . , n) will be described. For illustrative purposes, in the exemplary embodiment of FIG. 6, the (k+1)-th light emission block B(k+1) is determined by using the first reference Rk of the k-th light emission block Bk.

Firstly, the second reference determining unit 840 receives a plurality of parameters Para1, . . . , Para(n−1) or the single parameter Para_t from the parameter generator 830, and multiples the first reference Rk for the k-th light emission block Bk (k=1, . . . , n) by the parameter Para_k, wherein a multiplied result is set as a first value V1. Here, the parameter Para_k may be a k-th parameter among a plurality of parameters Para1, . . . , Para(n−1) shown in FIG. 3 and FIG. 4 or the same single parameter Para_t that applies to all first references R1, . . . , Rn. The first reference of the neighboring light emission block of which second reference is to be determined is set as a second value V2. Here, the (k+1)-th light emission block B(k+1) is illustrated as an example of a neighboring light emission block of the k-th light emission block B(k), and thus, the first reference R(k+1) for the (k+1)-th light emission block B(k+1) is set as the second value V2.

Next, the second reference determining unit 840 compares the first value V1 and the second value V2 to determine a larger value between the two values V1 and V2 as the second reference R(k+1') of the (k+1)-th light emission block B(k+1).

In the above described manner, the second references R2', . . . , Rn' corresponding to the second light emission block B2 to the n-th light emission block Bn may be determined. Also, the (k−1)-th light emission block B(k−1) may be determined as the neighboring light emission block of the k-th light emission block B(k), and the second references R(n−1)', . . . , R1' corresponding to the (n−1)-th light emission block B(n−1) to the first light emission block B1 may be determined. Thus, one second reference R1' for the first light emission block B1, two sets of the second references R2', . . . , R(n−1)' for each of the light emission blocks B2, . . . , B(n−1), and one second reference Rn' for the n-th light emission block Bn may be determined. Next, one of these two second references R2', . . . , R(n−1)' is selected for each of the light emission blocks B1, . . . , Bn. Here, for example, to improve the luminance, the second reference R2', . . . , R(n−1)' having a higher luminance may be selected for the second reference of each of the light emission blocks B2, . . . , B(n−1).

The second reference R1', . . . , Rn' for the light emission block of B1, . . . , Bn is provided as the control signal of the light source driver 950 to be used to generate the driving signal of the light source 900.

As described in the exemplary embodiments shown in FIG. 4 to FIG. 6, when the weighted references WDf1, . . . , WDf(n−1) are used in determining the second references R1', . . . , Rn', the second references R1', . . . , Rn' for the light emission block B1, . . . , Bn may have a value depending on a luminance difference between the neighboring light emission blocks B1, . . . , Bn and/or a position of the light emission blocks B1, . . . , Bn.

In the above description, a one-dimensional local dimming driving method is applied in which the light source 900 is divided into a plurality of light emission blocks B1, . . . , Bn arranged in one direction and the luminance of each light emission block of B1, . . . , Bn is individually controlled. However, the invention is not limited thereto, and the light source 900 may be divided into a plurality of light emission blocks a two-dimensional method as shown in FIG. 7 and FIG. 8.

Figure 8:
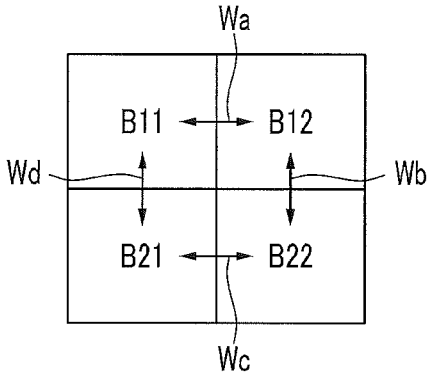
FIG. 8 is a view illustrating a 2×2 matrix blocks among the plurality of the blocks of the light source of the display of FIG. 7.

FIG. 7 is a view illustrating another exemplary embodiment of a plurality of blocks of a light source of a display device and a first reference determined by a first reference determining unit according to the invention, and FIG. 8 is a view illustrating a 2×2 matrix blocks among the plurality of the blocks of the light source of the display of FIG. 7. Referring to FIG. 7 and FIG. 8, the light source 900 according to an exemplary embodiment of the invention is divided into a plurality of light emission blocks Bij (i=1, . . . , n, j=1, . . . , m) arranged in an n×m matrix. Accordingly, the first reference determining unit 810 determines a first reference Rij (i=1, . . . , n, j=1, . . . , m) of a light emission block Bij based on the input image signal IDAT corresponding to a display area of each light emission block Bij.

The same driving method described in FIG. 3 to FIG. 6 may be applied to the exemplary embodiment of FIG. 7 in which the light source 900 is divided into a plurality of light emission blocks Bij (i=1, . . . , n, j=1, . . . , m) arranged in the n×m matrix. In detail, the driving method according to the exemplary embodiment shown in FIG. 3 to FIG. 6 may be respectively applied to each row and each column of a plurality of the light emission blocks Bij (i=1, . . . , n, j=1, . . . , m) arranged in the n×m matrix such that the second reference Rij' (i=1, . . . , n, j=1, . . . , m) corresponding to the light emission blocks Bij (i=1, . . . , n, j=1, . . . , m) may be determined.

Here, the weight value corresponding to the reference difference between light emission blocks Bij (i=1, . . . , n, j=1, . . . , m) neighboring in a row or column direction may be respectively determined. In an exemplary embodiment, as shown in FIG. 8, with respect to four neighboring light emission blocks B11, B12, B21, and B22 that for a 2×2 matrix, a weight value Wa to be multiplied by the reference difference between the light emission block B11 and the light emission block B12, a weight value Wb to be multiplied by the reference difference between the light emission block B12 and the light emission block B22, a weight value We to be multiplied by the reference difference between the light emission block B21 and the light emission block B22, and a weight value Wd to be multiplied by the reference difference between the light emission block B11 and the light emission block B21 may be respectively determined. Accordingly, an N number of weight values may be required for all light emission blocks Bij (i=1, . . . , n, j=1, . . . , m), N being determined according to Equation 1 expressed below.

$$N=(m-1)*n+(n-1)*m \quad \text{[Equation 1]}$$

However, in an alternative embodiment, at least two weight values among the weight values Wa, Wb, Wc, and Wd for the four neighboring light emission blocks Bij (i=1, . . . , n, j=1, . . . , m) may be set to be equal. Accordingly, in order to use a smallest possible number of the weight value, the weight values Wa, Wb, Wc, and Wd for the four neighboring light emission blocks Bij (i=1, . . . , n, j=1, . . . , m) may be the same. In this case, the number N of the weight values required for all light emission blocks Bij (i=1, . . . , n, j=1, . . . , m) may be determined as Equation 2 expressed below.

$$N=(n-1)*(m-1) \quad \text{[Equation 2]}$$

Next, a result of applying the driving method of the display device according to an exemplary embodiment of the invention to images of several examples will be described with reference to FIG. 9 to FIG. 20.

Figure 10:
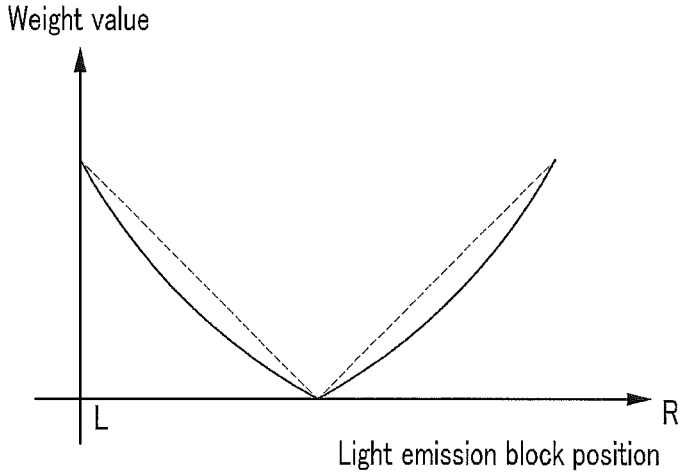
FIG. 10 is a graph illustrating an exemplary embodiment of a relationship between a weight value and a position of a light emission block according to the invention.
Figure 11A:
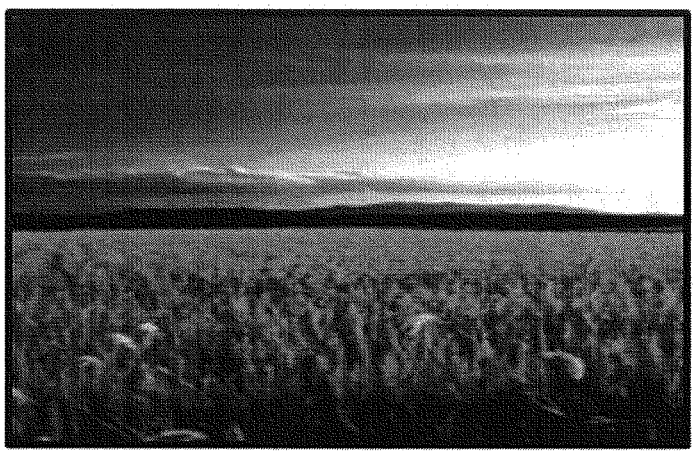
FIGS. 11A, 12A, 13A, 14A, 15A, 16A, 17A, 18A, 19A, and 20A are views showing the several exemplary embodiments of the images of FIG. 9.
Figure 11B:
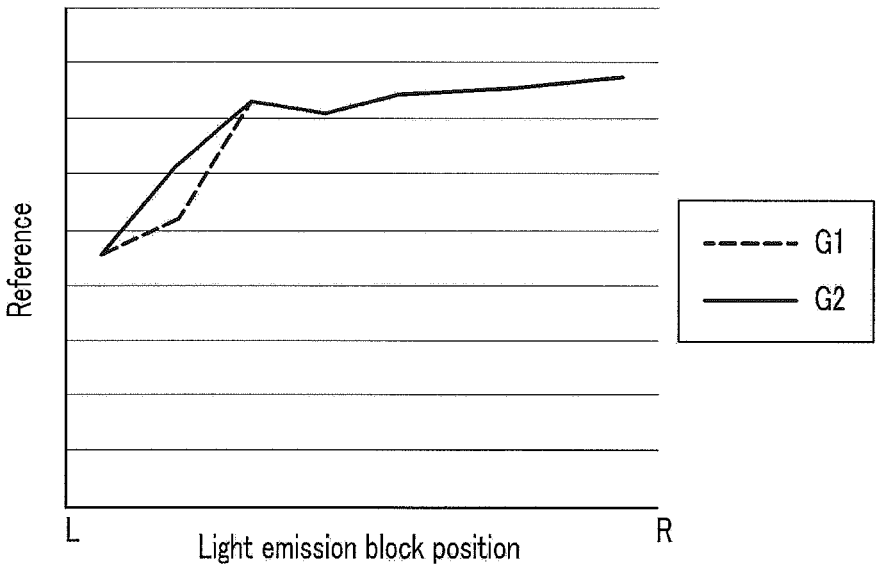
FIGS. 11B, 12B, 13B, 14B, 15B, 16B, 17B, 18B, 19B, and 20B are graphs showing a first reference and a second reference of a light emission block in the several exemplary embodiments of the images of FIG. 9.

FIG. 9 shows tables illustrating example values of a first reference, a parameter, and a second reference of a light emission block corresponding to several exemplary embodiments of images according to the invention, FIG. 10 is a graph showing an exemplary embodiment of a relationship between a weight value and a position of a light emission block according to the invention, FIGS. 11A, 12A, 13A, 14A, 15A, 16A, 17A, 18A, 19A, and 20A are views showing the several exemplary embodiments of the images of FIG. 9, and FIGS. 11B, 12B, 13B, 14B, 15B, 16B, 17B, 18B, 19B, and 20B are graphs showing a first reference and a second reference of a light emission block in the several exemplary embodiments of the images of FIG. 9.

FIG. 9(*a*) shows the first references G1 according to a position of the light emission block for images img1, . . . , img10 shown in FIG. 11A to FIG. 20A, and a unit of the first reference G1 may be the same as a unit of luminance. The first references G1 are expressed as graphs in FIG. 11B to FIG. 20B.

FIG. 9(*b*) shows the single parameter Para_t calculated according to the exemplary embodiment shown in FIG. 5, and an example of the weight value of the weight value look-up table 832 to be used for generating the single parameter Para_t is shown in FIG. 10. According to the exemplary embodiment shown in FIG. 10 the weight values W1, . . . , W(n−1) are gradually decreased according to the position of the light emission block from a left side L to a center position, reaches zero at the center position, and are increased from the center position to a right side R. The increasing or decreasing slope of the weight values W1, . . . , W(n−1) may be determined variously, as shown in a solid line or a dotted line in the graph shown in FIG. 10. As described above, when the weight value of zero is applied to the light emission block positioned at the center position, the single parameter Para_t calculated for the image img2 shown in FIG. 12A may be zero, as shown in table of FIG. 9(*b*).

Referring to FIG. 9(*b*), it is shown that the single parameter Para_t or at least one parameter of Para1, . . . , Para(n−1) corresponding to the neighboring light emission blocks may have different values depending on the image img1, . . . , img40 to which the single parameter Para_t or the parameters Para1, . . . , Para(n−1) apply.

Figure 12A:
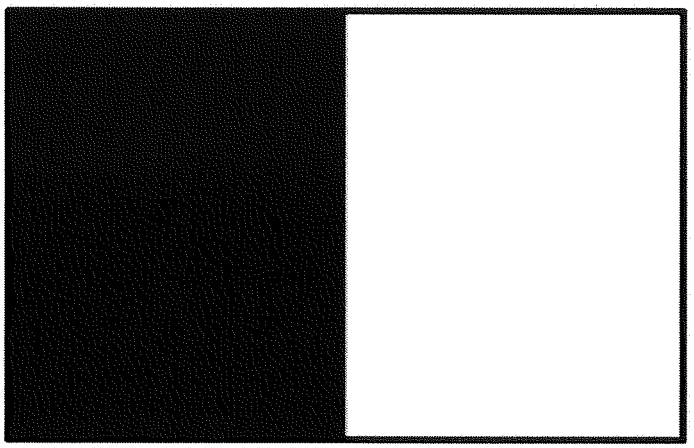
Figure 12B:
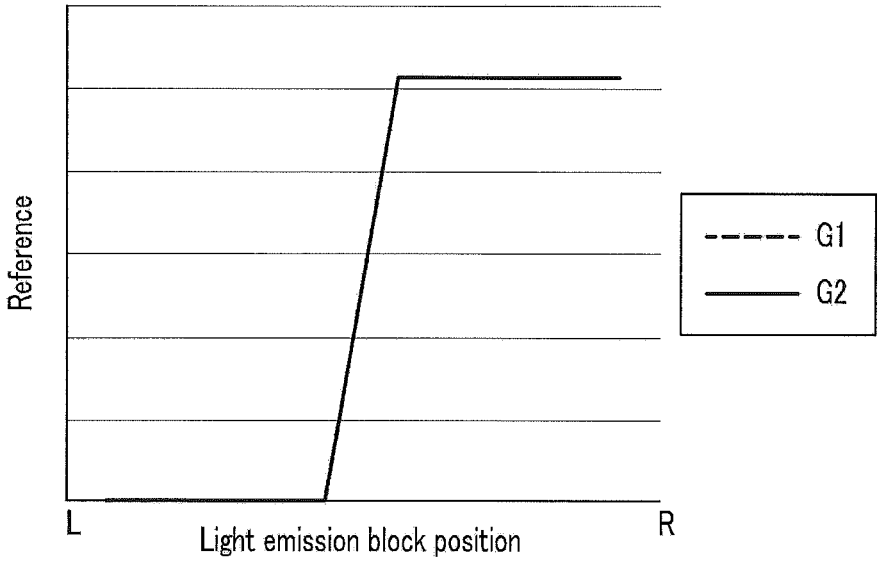
Figure 13A:
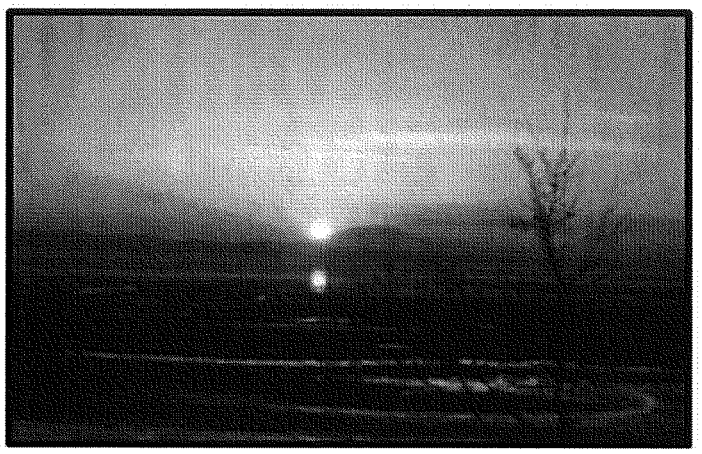
Figure 13B:
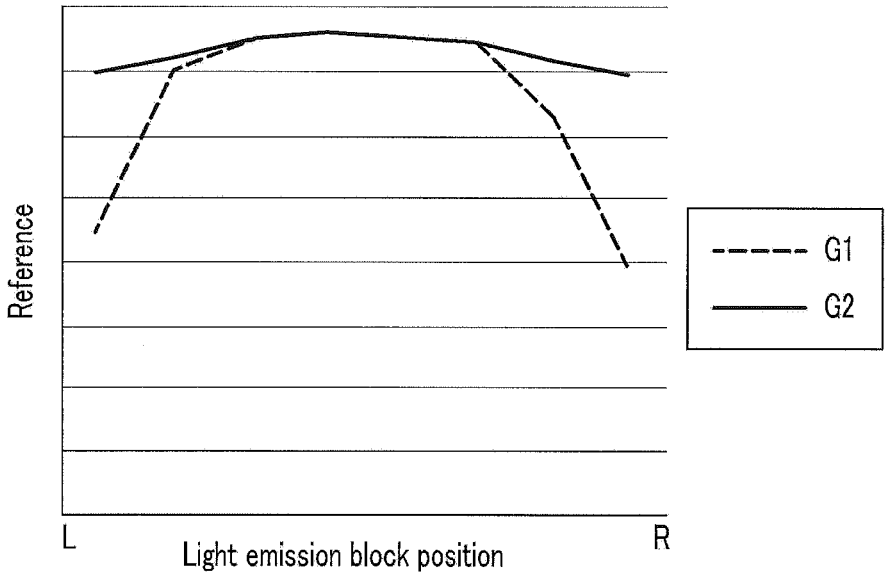
Figure 14A:
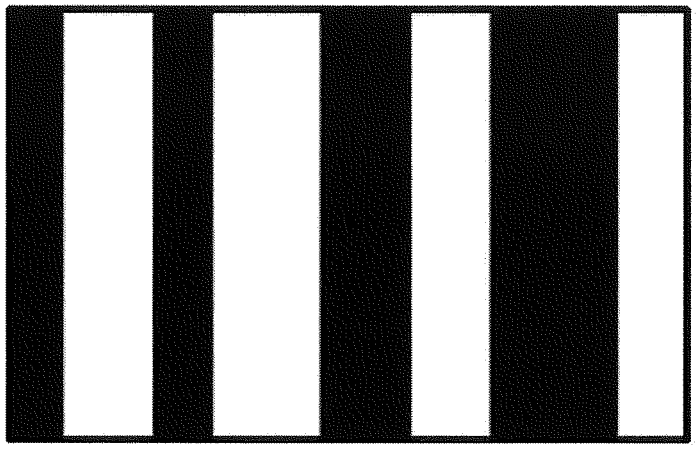
Figure 14B:
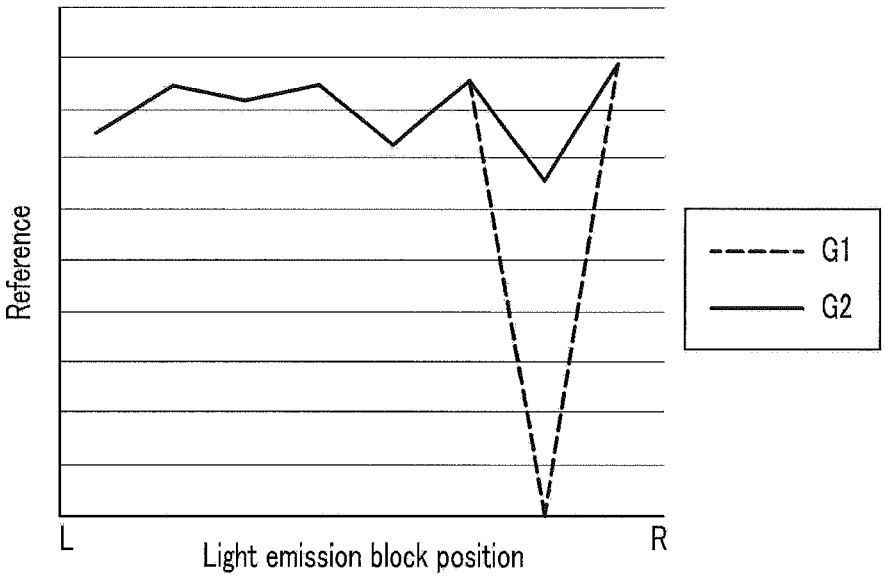
Figure 15A:
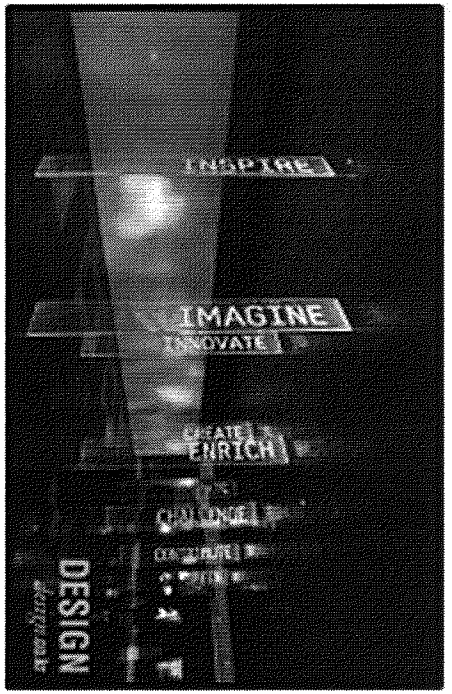
Figure 15B:
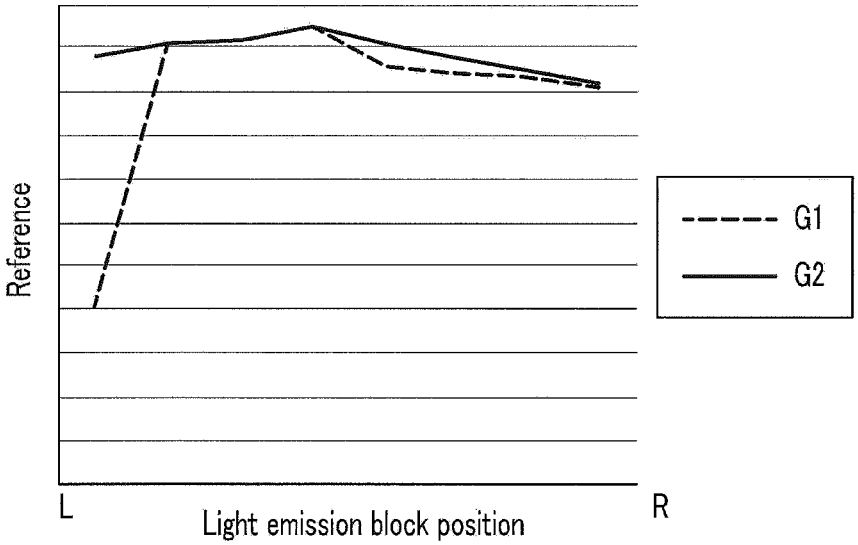
Figure 16A:
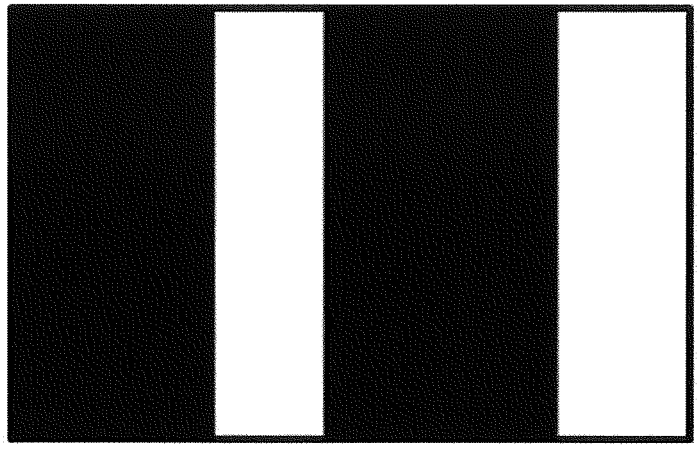
Figure 16B:
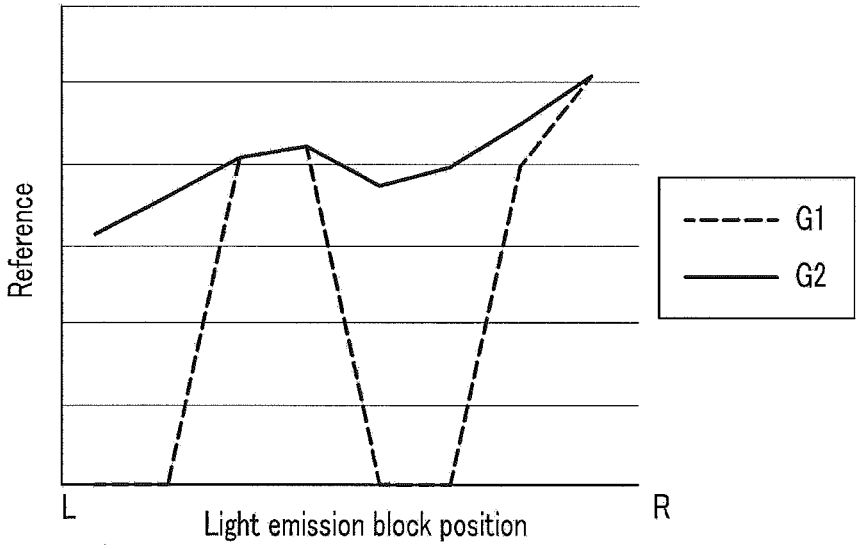
Figure 17A:
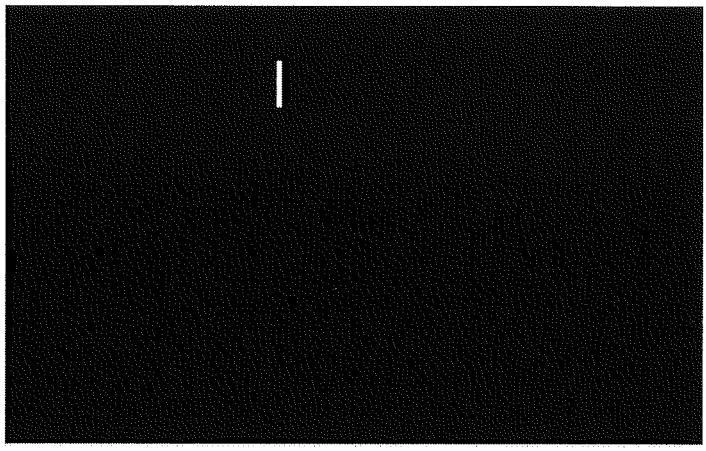
Figure 17B:
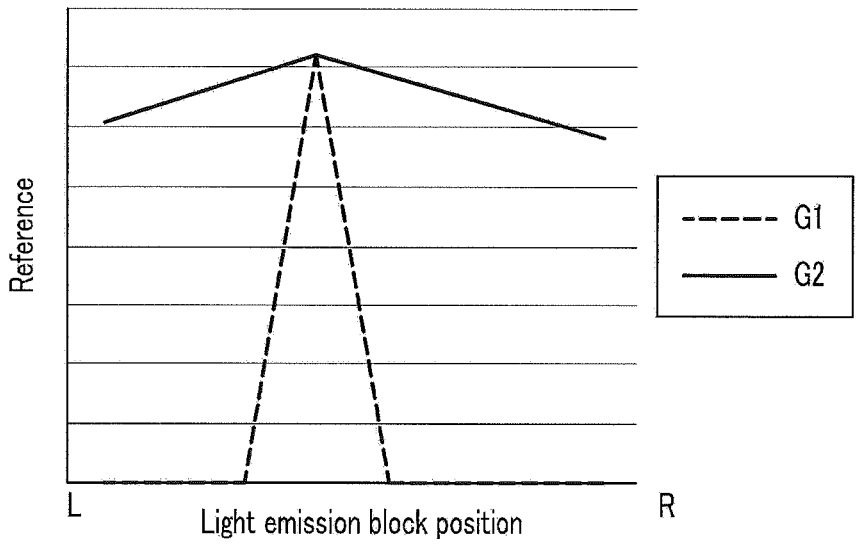
Figure 18A:
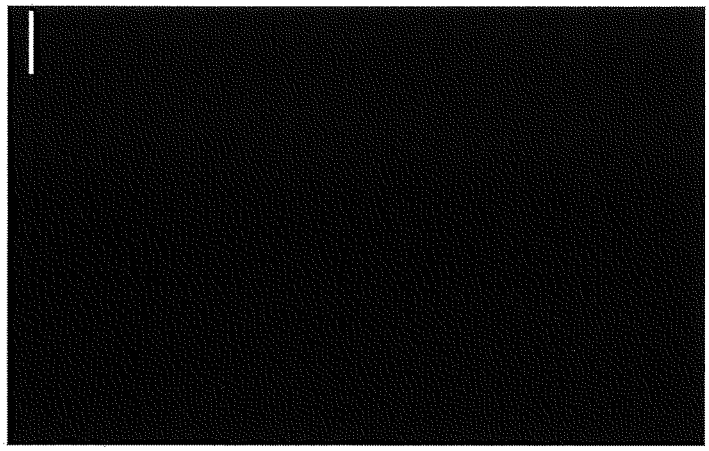
Figure 18B:
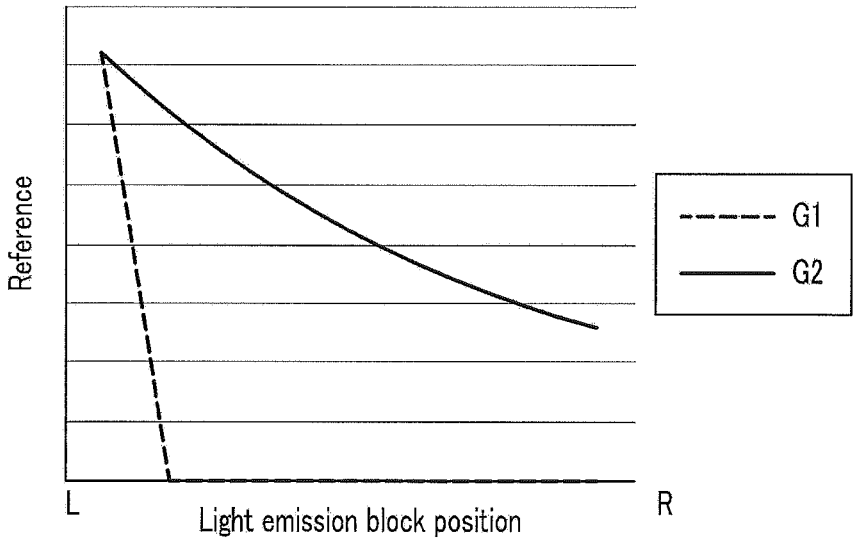
Figure 19A:
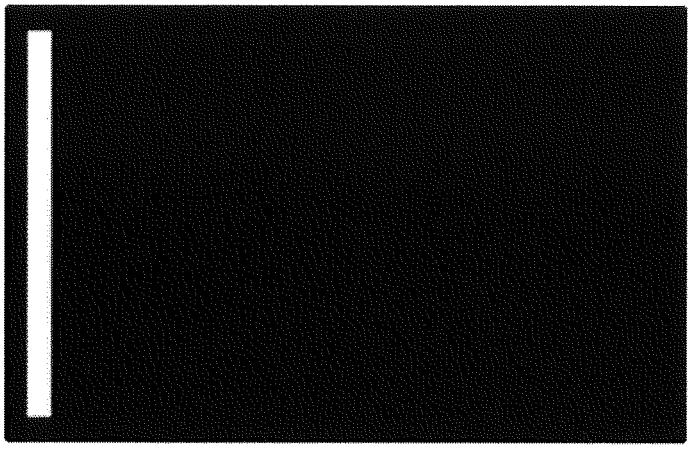
Figure 19B:
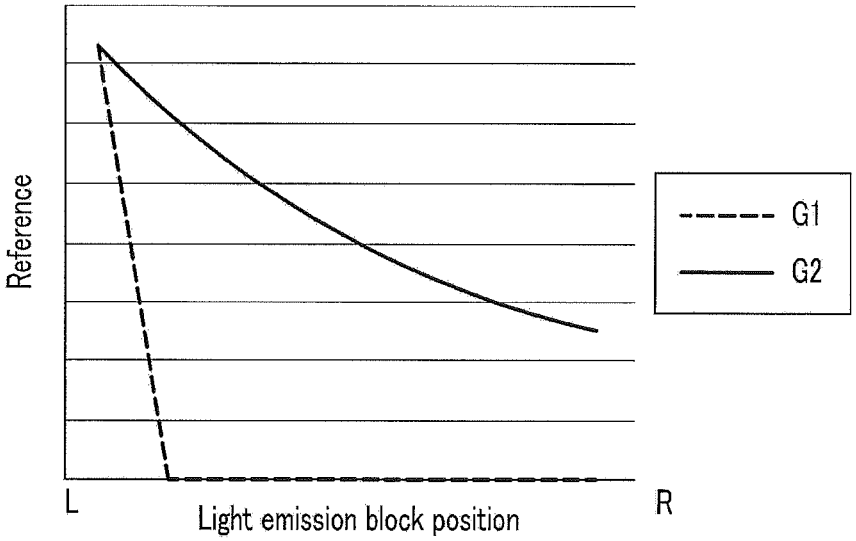

FIG. 9(*c*) shows the second reference G2 for the light emission block calculated according to the exemplary embodiment shown in FIG. 5 and FIG. 6. When the single parameter Para_t calculated for the image img2 shown in FIG. 12A is zero, the second reference G2 of the light emission block is the same as the first reference G1. Accordingly, since a light quantity or luminance of the light emission block corresponding to a left black image shown in FIG. 12A is zero, the contrast ratio may be significantly enhanced and the power consumption may be substantially reduced and/or effectively minimized, compared with the conventional local dimming driving method. Similarly, the second reference G2 capable of substantially reducing the power consumption may also be obtained even in a case of a general image in which a large gray difference is not shown in a center portion.

In detail, as shown in FIGS. 11A, 11B, 13A, 13B, 15A, and 15B, when the luminance of the image is not quickly changed depending on the position of the light emission block but is uniformly distributed among the light emission blocks, at least one parameter Para_k (k=1, . . . , (n−1)) corresponding to the neighboring light emission blocks or the value of the single parameter Para_t may be relatively large, and the light emission block having a relatively low first reference G1 may be affected by the first reference G1 or the second reference G2 of the neighboring light emission block such that the second reference G2 may have a higher value than the first reference G1. However, compared to the conventional local dimming driving method in which a parameter for performing local dimming is determined regardless of the kind of image and/or the position of the light emission block, according to an exemplary embodiment of the invention, the local dimming is performed by using a parameter determined based on the kind of the image and/or the position of the light emission block such that the power consumption may be substantially reduced and/or effectively minimized and the contrast ratio may be further increased.

As shown in FIGS. 14A, 14B, 16A, 16B, 17A, 17B, 18A, 18B, 19A, and 19B, in a case of an image where black and white are alternately disposed, the power consumption may be substantially reduced and/or effectively minimized and the contrast ratio may be further increased by using the parameter determined based on the kind of image and/or the position of the light emission block. The second reference G2 of the light emission block of which neighboring light emission block has a relatively high luminance may be higher than the first reference G1 of the corresponding light emission block.

Figure 20A:
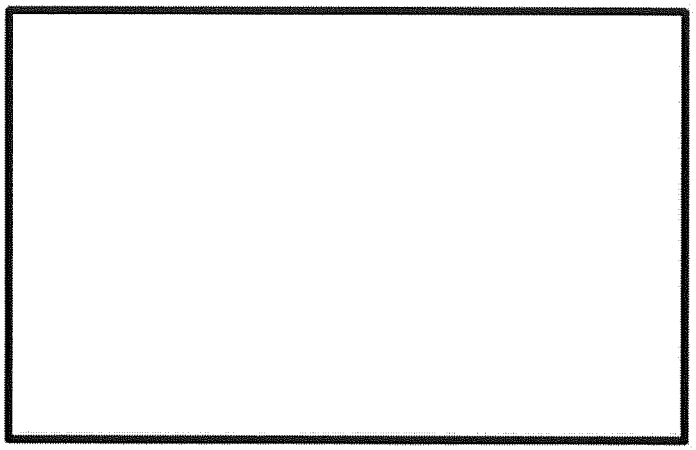
Figure 20B:
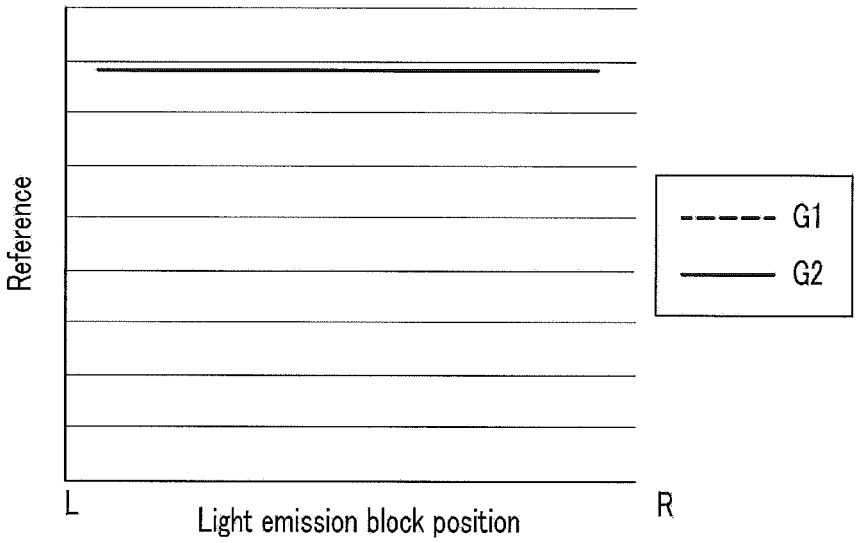

In a case of a white image shown in FIG. 20A and FIG. 20B, the second reference G2 is the same as the first reference G1.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel which displays an image;

a light source unit which provides light to the display panel; and a light source controller which transmit a control signal to the light source unit, wherein the light source unit includes a light source including a plurality of light emission blocks, wherein the light source controller includes:

a first reference determining unit which determines first references for the plurality of the light emission blocks based on an input image signal, a reference difference calculator which calculates at least one reference difference for neighboring light emission blocks by using first references for corresponding neighboring light emission blocks, a parameter generator which generates at least one parameter by using the at least one reference difference, and a second reference determining unit which determines a second reference for a corresponding light emission block by using the first references for the plurality of light emission blocks and the at least one parameter, and wherein the at least one reference difference is determined as an absolute value of a difference between the first references of the neighboring light emission blocks, or an n square (n is a natural number larger than 1) of the difference between the first references of the neighboring light emission blocks.

2. The display device of claim 1, wherein the parameter generator normalizes the at least one reference difference for the neighboring light emission blocks to generate the at least one parameter corresponding to the neighboring light emission blocks.

3. The display device of claim 1, wherein the second reference determining unit determines a first value by multiplying a parameter, which corresponds to a first light emission block and a second light emission block neighboring the first light emission block, by the first reference of the first light emission block, determines a second value as the first reference of the second light emission block, and compares the first value and the second value to determine the second reference of the second light emission block.

4. The display device of claim 1, wherein the parameter generator includes at least one of, a weight value look-up table which stores at least one weight value respectively corresponding to the neighboring light emission blocks, and a multiplier which multiplies the at least one reference difference by a corresponding weight value to obtain at least one weighted reference.

5. The display device of claim 4, wherein the parameter generator normalizes the at least one weighted reference calculated for the neighboring light emission blocks to generate the at least one parameter corresponding to the neighboring light emission blocks.

6. The display device of claim 1, wherein the second reference determining unit determines a first value by multiplying a parameter, which corresponds to a first light emission block and a second light emission block neighboring the first light emission block, by the first reference of the first light emission block, determines a second value as the first reference of the second light emission block, and compares the first value and the second value to determine the second reference of the second light emission block.

7. The display device of claim 4, wherein the parameter generator further includes an adding unit which adds the at least one weighted reference.

8. The display device of claim 7, wherein the parameter generator generates one single parameter by using an output of the adding unit.

9. The display device of claim 1, wherein the second reference determining unit determines a first value by multiplying the single parameter by the first reference of a first light emission block, determines a second value as the first reference of a second light emission block neighboring the first light emission block, and compares the first value and the second value to determine the second reference of the second light emission block.

10. The display device of claim 1, wherein the plurality of the light emission blocks are arranged in an n×m matrix.

11. The display device of claim 10, wherein the parameter generator includes at least one of, a weight value look-up table which stores at least one weight value respectively corresponding to the neighboring light emission blocks, and a multiplier which multiplies the at least one reference difference by a corresponding weight value to obtain at least one weighted reference, and wherein two light emission blocks neighboring in a row direction or a column direction in a 2×2 matrix have an identical weight value.

12. A method of driving a display device, the method comprising:

determining first references for a plurality of light emission blocks based on an input image signal;

calculating at least one reference difference for neighboring light emission blocks by using first references for corresponding neighboring light emission blocks;

generating at least one parameter by using the at least one reference difference;

determining a second reference for a corresponding light emission block by using the first references for the plurality of the light emission blocks and the at least one parameter; and providing a driving signal to the plurality of the light emission blocks based on the second reference, wherein the display device includes a light source including the plurality of the light emission blocks and a display panel which is provided with light by the light source, and the at least one reference difference is determined as an absolute value of a difference between the first references of the neighboring light emission blocks or an n square (n is a natural number larger than 1) of the difference between the first references of the neighboring light emission blocks.

13. The method of claim 12, wherein the generating the at least one parameter includes normalizing the at least one reference difference for the neighboring light emission blocks to generate the at least one parameter corresponding to the neighboring light emission blocks.

14. The method of claim 12, wherein the generating the at least one parameter includes:

multiplying the at least one reference difference for the neighboring light emission blocks by at least one weight value corresponding to the neighboring light emission blocks to calculate at least one weighted reference; and normalizing the at least one weighted reference to generate at least one parameter corresponding to the neighboring light emission blocks.

15. The method of claim 14, wherein the generating the at least one parameter further includes:

adding the at least one weighted reference; and generating one single parameter by using an addition result.

16. The method of claim 12, wherein the determining the second reference includes, determining a first value by multiplying the at least one parameter by the first reference of a first light emission block, determining a second value as the first reference of a second light emission block neighboring the first light emission block, and comparing the first value and the second value to determine the second reference of the second light emission block.

* * * * *